US006756110B2

(12) United States Patent
Shibata

(10) Patent No.: US 6,756,110 B2
(45) Date of Patent: Jun. 29, 2004

(54) CUTTING TOOL

(75) Inventor: Daisuke Shibata, Kagoshima (JP)

(73) Assignee: Kyocera Corporation, Kyoto (JP)

( * ) Notice: Subject to any disclaimer, the term of this patent is extended or adjusted under 35 U.S.C. 154(b) by 139 days.

(21) Appl. No.: 10/007,309

(22) Filed: Nov. 30, 2001

(65) Prior Publication Data

US 2003/0010166 A1 Jan. 16, 2003

(30) Foreign Application Priority Data

Nov. 30, 2000 (JP) ..... 2000-366207

(51) Int. Cl.[7] ..... C23C 29/00

(52) U.S. Cl. ..... 428/212; 51/307; 51/309; 407/119; 428/336; 428/697; 428/698; 428/699

(58) Field of Search ..... 428/697, 698, 428/699, 336, 212, 323; 75/243; 51/307, 309; 407/119

(56) References Cited

U.S. PATENT DOCUMENTS 5,380,688 A * 1/1995 Dunmead et al.
5,447,549 A * 9/1995 Yoshimura
5,503,925 A * 4/1996 Nakano et al.
5,580,666 A * 12/1996 Dubensky et al.
5,643,658 A * 7/1997 Uchino et al.
5,918,103 A * 6/1999 Kobayashi et al.
5,976,707 A * 11/1999 Grab
5,993,506 A * 11/1999 Kobayashi et al.
6,007,598 A * 12/1999 Dunmead et al.
6,217,992 B1 * 4/2001 Grab

* cited by examiner

*Primary Examiner*—Archene Turner
(74) *Attorney, Agent, or Firm*—Hogan & Hartson LLP

(57) ABSTRACT

A cutting tool of the invention comprises a cemented carbide main body and a coating layer formed on the surface of the main body, wherein a region where a reduction ratio of Zr to the inside of the main body is smaller than a reduction ratio of other metals of the groups 4a, 5a and 6a in the Periodic Table, is disposed in the vicinity of the surface of the cemented carbide main body. Therefore, wear resistance and plastic deformation resistance to hardly machinable materials such as stainless steel can considerably be improved for elongating tool life.

9 Claims, 3 Drawing Sheets

CUTTING TOOL

FIELD OF THE INVENTION

The present invention relates to a cutting tool composed of coated cemented carbide based on tungsten carbide, which has high strength and high toughness and is particularly suited for cutting hardly machinable materials such as stainless steel.

BACKGROUND OF THE INVENTION

As cemented carbide of widespread use for cutting metals, there has hitherto been known a WC—Co alloy comprising a hard phase containing tungsten carbide as a principal component and a binder phase made of a metal of the iron group such as cobalt, or an alloy obtained by adding carbides, nitrides or carbonitrides of metals of the groups 4a, 5a and 6a in the Periodic Table to the WC—Co alloy. In the latter, grains of the solid solution composed of both WC and carbides, nitrides or carbonitrides of metals of the groups 4a, 5a and 6a in the Periodic Table are added to the hard phase and binder phase.

These cemented carbides are now adopted, as a cutting tool, mostly for cutting cast iron and carbon steel. In recent years, they have also found application in cutting stainless steel. The stainless steel has been used in various fields because it is excellent in corrosion resistance, oxidation resistance and heat resistance. Thus, the processing amount of the stainless steel is increasing year by year.

However, the stainless steel is known as a typical hardly machinable material because of the occurrence of work hardening, low thermal conductivity, and high affinity with tool materials.

Among WC cemented carbides for cutting tool, cemented carbide that is classified into so-called M series in accordance with JIS B 4053 (1996) is generally used to cut stainless steel. In the M series, WC—TiC—Ta(Nb)C—Co cemented carbide is mostly used, and TiC and Ta(Nb)C are added in a relatively small amount in order to impart toughness.

However, when stainless steel is cut even with a cutting tool made of conventionally cemented carbide of the M series, it is difficult to perform satisfactory cutting for a long time because the wear or the cutting tool is severe and thus its tool life expires in a short time.

In addition, the cutting resistance from the stainless steel surface subjected to work hardening during cutting can lead to severe damage of a primary boundary portion, resulting in a short tool life.

SUMMARY OF THE INVENTION

It is an object of the present invention to provide a cutting tool having a long tool life, which has improvements in wear resistance and plastic deformation resistance even when cutting hardly machinable materials such as stainless steel.

It is another object of the present invention to provide a method of cutting metal, such as hardly machinable materials (e.g., stainless steel).

The present inventor had intensive study of the foregoing problems and found the following novel fact. That is, in case that a region where a reduction ratio of Zr to the inside of a cemented carbide main body is smaller than a reduction ratio of other metals selected from the groups 4a, 5a, and 6a in the Periodic Table, is formed in vicinity of the surface of the cemented carbide main body, the resulting cemented carbide has excellent mechanical strength, as well as excellent wear resistance and plastic deformation resistance to the cutting of stainless steel.

A conventional cutting tool makes the machined surface of the material to be cut deteriorate by occurrence of chipping that is due presumably to deposition. Whereas in the present invention, the cemented carbide body itself can be strengthen and chipping resistance can also be improved by forming the above-mentioned region in the the surface portion of the cemented carbide main body.

Specifically, a cutting tool of the present invention comprises: a cemented carbide main body comprising a hard phase made up of WC and two or more selected from carbides, nitrides and carbonitrides at metals of the groups 4a, 5a and 6a in the Periodic Table, including Zr, and a binder phase composed of at least one metal of the iron group, and a coating layer formed on the surface of the cemented carbide main body. Especially, a region where a reduction ratio of Zr to the inside of the cemented carbide main body is smaller than a reduction ratio of other metals of the groups 4a, 5a and 6a in the Periodic Table is formed in the surface portion of the main body.

Further, according to the present invention, there is provided a method of cutting metal, such as hardly machinable materials (e.g., stainless steel), with the cutting tool as described above.

The other objects and advantages of the present invention will become apparent from the following detailed description.

DETAILED DESCRIPTION OF THE INVENTION

A cutting tool according to the present invention comprises a cemented carbide main body having a coating layer on its surface. The cemented carbide main body is made up of a hard phase and a binder phase.

The hard phase comprises WC and two or more carbides, nitrides, or carbonitrides of metals selected from the groups 4a, 5a and 6a in the Periodic Table, including Zr. The hard phase preferably contains WC and a solid solution of the WC and two or more carbides, nitrides or carbonitrides of metals selected from the groups 4a, 5a and 6a in the Periodic Table (a complex carbide solid solution or a complex carbonitride solid solution). It is more preferable that the solid solution contains Nb, since reduction of the solid solution metal except for Zr is accelerated in the surface region due to containing Nb, whereby the region where reduction ratio of Zr is small can be accurately prepared.

The binder phase contains, as a principal component, a metal of the iron group such as Co. The binder phase is preferably contained in the proportion of 5 to 15% by weight in the cemented carbides. When the proportion of the binder phase is higher than the above range, hardness and compressive strength are likely to deteriorate, and therefore, wear resistance deteriorates and the amount of wear of the cutting tool increases. On the other hand, when the proportion of the binder phase is lower than the above range, toughness is poor due to insufficient bond with the hard phase. As a result, tool chipping is liable to occur during machining.

In the cutting tool of the invention, a region where a reduction ratio of Zr to the inside of the cemented carbide main body is smaller than that of other metals selected from the groups 4a, 5a, and 6a in the periodic Table, is present in the vicinity of the surface of the cemented carbide main body. The region is excellent in toughness and plastic deformation resistance at high temperatures, thereby increasing chipping resistance and wear resistance of the cutting tool. It is a dominant factor causing these effects that Zr is excellent in toughness and plastic deformation resistance at high temperatures. Further, in the above-mentioned region, as most of the metals of the groups 4a, 5a and 6a, except for Zr, are decreased, the binder phase is increased proportionally. Such an increase of the binder phase contributes to reinforcement of toughness. Furthermore, since an increased binder phase contains a slight amount of Zr mainly, it cannot have any adverse effect upon plastic deformation resistance. Accordingly, in the cutting tool of the invention, Zr has excellent plastic deformation resistance at high temperatures, and this characteristic contributes to improvement in wear resistance.

Figure 1:
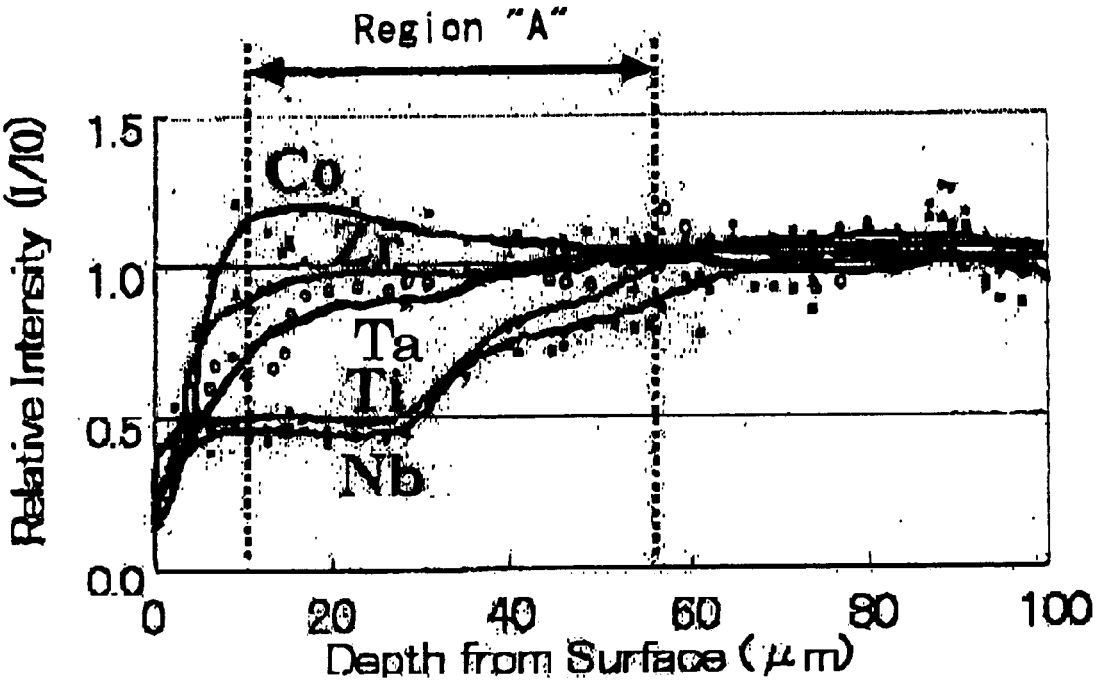
FIG. 1 is a graph showing a distribution state of elements in the direction of depth from surface to inside, which is an exemplary result obtained by analyzing a cutting tool of the invention with an XMA.

The reduction ratio of Zr to the inside of the cemented carbide main body can be found with an XMA (X-ray micro analyzer). A concentration distribution of each metal in the cutting tool of the invention is shown in the graph of FIG. 1. FIG. 1 shows the state of distribution of element in the direction of depth from surface to inside. The abscissa represents a depth from the surface, and the value 0 $\mu$m indicates the body surface. The ordinate represents a ratio of X-ray peaks to the count of the inside, that is, a peak intensity ratio. A depth region of 10 $\mu$m from the surface of the cemented carbide corresponds to an edge of the sample. Accordingly, in this region, a peak count is lowered in view of an analyzing principle, thereby failing to measure accurate count. Therefore, in the present invention, a position of 10 $\mu$m depth from the surface of the cemented carbide is employed as a reference surface. Based on this graph, a region "A" where the proportion of the peak intensity ratio of Zr to the sum of the peak intensity ratios of metals selected from the groups 4a, 5a, and 6a in the Periodic Table, is not less than 120% of the proportion of the peak intensity ratio of the inside of the body (i.e., the region where the peak intensity is stable) can be defined as a region where the reduction ratio of Zr to the inside of the cemented carbide main body is small. The reason why the value "120%" is employed is to take a measurement error into consideration.

In order to enhance the toughness on the surface of the cemented carbide, it is desirable that the reduction ratio of Zr in the region "A" to the amounts of Zr in the inside is 80 to 98%, preferably 85 to 95%. Also, it is desirable that the region where the reduction ratio of Zr to the inside of the cemented carbide main body is small is formed continuously in a thickness of 5 to 100 $\mu$m, preferably 30 to 80 $\mu$m from the main body surface toward the inside. The reason why the above range is preferable is as follows. When the thickness or the region having a small reduction ratio of Zr to the inside of the cemented carbide main body is less than 5 $\mu$m, strength may be insufficient and the cutting tool may be susceptible to plastic deformation and chipping. When it exceeds 100 $\mu$m, wear resistance deteriorates, and there may be a markedly increase in tool wear.

It is preferable that two or more B1 type solid solutions are present in the cemented carbide main body, and that at least one of the B1 type (cubic system type) solid solutions has a high Zr content. This is because the B1 type solid solution having a high Zr content is extremely excellent in toughness and plastic deformation resistance at high temperatures.

It is more preferable that the B1 type solid solution is present in the region where a reduction ratio of Zr to the inside of the cemented carbide main body is small, and that the B1 type solid solution in such a region is mainly the B1 type solid solution having a high Zr content. Thus, the effect of improving toughness and plastic deformation resistance at high temperatures can be enhanced.

Figure 2:
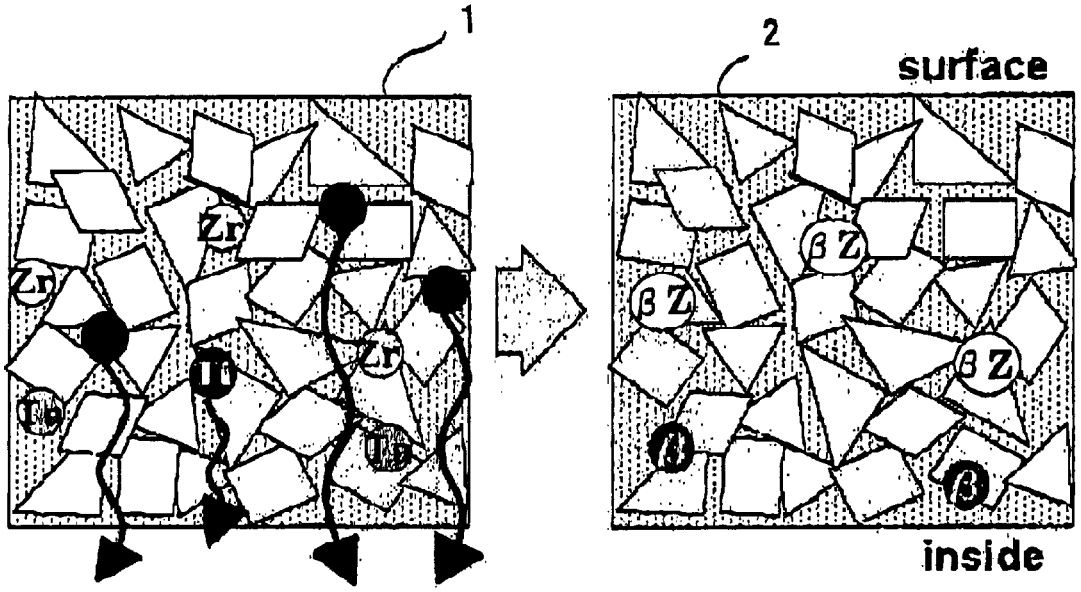
FIG. 2 is a schematic diagram of mechanism of forming a region where a reduction ratio of Zr to the inside of the cemented carbide main body including a B1 type solid solution is small.

FIG. 2 illustrates mechanism of forming a region, including the B1 type solid solution, where a reduction ratio of Zr to the inside of the cemented carbide main body is small. In FIG. 2, indicated as 1 shows a structure during a liquid phase sintering, and indicated as 2 shows a structure formed after cooling. In FIG. 2, white polygons represent WC, and gray portions filling the spaces represent Co. Dots indicate Nb. The circles with Zr, Ti and Ta indicate Zr, Ti and Ta, respectively, and βZ indicates B1 type solid solutions having a high Zr content. As seen from the structure 1 of FIG. 2, during sintering, metal elements forming the B1 type solid solution are dissolved in the liquid phase of Co, and cause diffusion. It can be considered that among the elements being dissolved during sintering, Zr has a higher solubility and a low diffusion velocity than other elements, and therefore, Zr is left in the portions of the surface and remains in the surface region, as in the case of structure 2. On the other hand, Nb has a property being most apt to diffuse toward the inside. Accordingly, the certain region "A" can be formed in the surface of the cemented carbide by diffusing Nb in the inside together with other β metals. Thereby, a region where a reduction ratio of Zr to the inside of the cemented carbide main body is small is formed in the surface portions of the cemented carbide.

Figure 3:
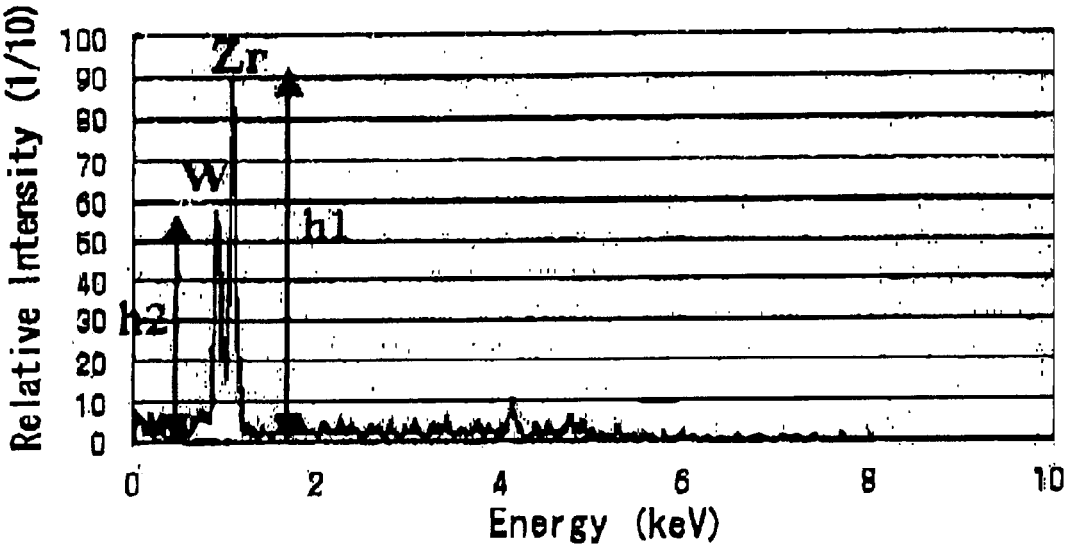
FIG. 3 is a graph showing an exemplary analysis result of an energy-dispersive X-ray diffraction of a B1 type solid solution having a high Zr content.

The B1 type solid solution having a high Zr content means a solid solution in which the ratio (h1/h2) of the peak intensity (h1) of Zr to the peak intensity (h2) of W is not less than 50%, preferably 55–160%, in an energy-dispersive X-ray diffraction. FIG. 3 shows an exemplary result of the energy-dispersive X-ray diffraction of the B1 type solid solution having a high Zr content. When the peak intensity (h1) of Zr is below 50% of the peak intensity (h2) of W, the amount of W is relatively large. It is therefore impossible to increase the hardness of the alloy, failing to exhibit high wear resistance and plastic deformation resistance.

The solid solution other than the solid solution having a high Zr content means a solid solution that metal other than Zr, i.e. at least one of Ti, V, Cr, Mo, Hf, Nb, Ta and w shows the highest peak intesity, and that the peak intesity of Zr is less than 50% to the above highest peak intesity, in the above energy-dispersive X-ray diffraction.

The B1 type solid solutions which has a high Zr content is temporarily distinguishable from the other solid solution by using the following method. An arbitrary cross section of a sintered body is ground and polished to obtain a mirror-like part. This part is then etched with a Murakami's reagent and observed under an optical microscope at 400 to 1000 magnifications. In this instance, the degree to which the B1 type solid solution is etched varies depending on the amount of Zr. Therefore, the above distinguishing is easy to carry out.

The ratio of the B1 type solid solution having a high Zr content to the other B1 type solid solution can be found from an area ratio. In the above-mentioned region, when the area ratio of the B1 type solid solution having a high Zr content to the whole B1 type solid solutions is 50% or more, it can be said that the B1 type solid solutions in the above-mentioned region are mainly the B1 type solid solution having a high Zr content.

The area ratio can be found in the following manner. First, the cutting tool is cut at an arbitrary portion, and the cross section thereof is ground and polished to obtain a mirror-like surface. Then this mirror-like surface portion is observed under an electron microscope (backscattered electron image). In the resulting photograph of the backscattered electron image, the solid solution having a high Zr content and the other solid solution are expressed in different colors, depending on the atomic number and atomic weight of the elements constituting the solid solution composition. Consequently, both solid solutions are distinguishable. Then, by image analysis method, the areas of both solid solutions in an arbitrary region (20 $\mu$m×20 $\mu$m) are measured to obtain an area ratio.

It is desirable that the B1 type solid solution having a high Zr content is present in the alloy as a phase of which average grain size is 3 $\mu$m or less. This is because when the average grain size exceeds 3 $\mu$m, the B1 type solid solution has poor wettability with the binder phase, thus lowering the strength of the alloy as a whole. The optimum average grain size is about 0.5 to 1.5 $\mu$m.

As material of the coating layer coated on the cemented carbide main body, there may be exemplified carbides, nitrides, and carbonitrides of metals of the groups 4a, 5a or 6a in the Periodic Table, such as TiC, TiN and TiCN, as well as TiAlN, $ZrO_2$ and $Al_2O_3$. It is desirable that the coating layer is formed in a thickness of 0.1 to 20 $\mu$m by CVD process or PVD process.

The cemented carbide of the present invention is prepared in the following manner. As raw powders, a WC powder, powders of one or more selected from ZrC, ZrN, ZrNbC and ZrWC, powders of one or more selected from carbides, nitrides and carbonitrides of metals of the groups 4a, 5a and 6a in the Periodic Table (especially a NbC powder), and iron group metal powder such as a Co power are weighed and mixed together. This mixture is then milled and molded by a known molding method such as press molding, followed by sintering.

The sintering is conducted at a temperature range of 1623 to 1823 K under vacuum having a vacuum level of 10 to $10^{-1}$ Pa, for 10 minutes to two hours. The region where a reduction ratio of Zr to the inside of the cemented carbide main body is small, can be formed in the vicinity of the surface of the main body by, for example, adjusting the proportion of a Zr compound to all the compounds constituting the B1 type solid solution that is a primary raw material, and delaying the temperature elevating velocity from around the liquid phase-appearing temperature to the sintering temperature, that is, the velocity of 5° C./min. or less.

This cemented carbide main body is then machined into the shape of a cutting tool, followed by washing. A coating layer is coated on the surface of the cutting tool.

The respective proportions of the raw materials are as follows. The WC powder is 70 to 95% by weight, preferably 85 to 95% by weight. The ZrC powder is 1.0 to 6.0% by weight. The powders of the compounds of metals of the groups 4a, 5a and 6a in the Periodic Table are 0.1 to 20% by weight, preferably 0.5 to 5% by weight. Especially, the NbC powder is 1.0 to 3.0% by weight. The power or iron group metal is 5 to 20% by weight, preferably 5 to 10% by weight.

EXAMPLES

The present invention will now be described by way of examples.

The respective material powders shown in Table 1 were mixed and milled. This was molded into a shape of CNMG432 and then fired at 1773 K under vacuum of not more than 1 Pa, for one hour.

The distribution of elements in the direction of depth, i.e. a peak intensity ratio to the inside, was analyzed with a high-accuracy WDS (wavelength dispersive X-ray micro analyzer, JXA-8600M, manufactured by Nihon Denshi Co., Ltd.). The analysis was made in the direction of depth, in an area of about 250 $\mu$m in parallel with the surface portion, in order to avoid variations of measurement. In the analysis, at least four or more locations were measured to obtain a mean value. As reference sample, a tool of CNMG432 was ground about 2,000 $\mu$m from its rake surface with a surface grinding machine, followed by mirror finish. The resulting surface was analyzed.

Based on an element distribution graph showing the analysis results, a region where the proportion of the peak intensity ratio of Zr to the sum of the peak intensity ratios of metals of the groups 4a, 5a and 6a in the Periodic Table was no less than 120% of the proportion of the peak intensity ratio in the inside of the body (i.e., the region where the peak intensity was stable) was taken as a region where a reduction ratio of Zr to the inside of the cemented carbide main body was small.

B1 Type solid solution which had a high Zr content was temporarily distinguished from others B1 type solid solutions by using the following method. An arbitrary cross section of a sintered body was ground and polished to obtain a mirror-like part. This part was then etched by a Murakami's reagent and observed under an optical microscope at 400 to 1000 magnifications. In this instance, the degree to which the B1 type solid solution was etched varied depending on the amount at Zr. Therefore, the B1 type solid solution could be distinguished easily.

In order to identify B1 type solid solution having a high Zr content, samples were prepared by performing a mirror finish to the grinding surface. With respect to an arbitrary region of an individual sample (20 $\mu$m×20 $\mu$m) for observation under a SEM electron microscope (backscattered electron image), the solid solution different in color from other B1 type solid solution (gray color) was determined as B1 type solid solution having a high Zr content. Further, the content of Zr was measured with an X-ray micro analyzer (PV9800) When an X-ray peak intensity of Zr was not less than 50% of that of W, it was taken as a solid solution having a high Zr content.

Further, to obtain the proportions of the B1 type solid solution having a high Zr content and the other B1 type solid solution, areas of the B1 type solid solutions having different colors in the above observation under the SEM electron microscope were measured by image analysis method. Based on the obtained images, a mean grain diameter of the B1 type solid solution having a high Zr content was obtained. The results are shown in Table 1.

TABLE 1

| Sample No. | Composition (wt. %) Co | Metal compounds[1] TiC | TaC | NbC | ZrC | WC | Rate of Zr compound in metal compounds[1] (wt. %) | Coating layer (5 μm) | Region where reduction ratio of Zr to the inside of the main body is small: Region[2] | Thickness (μm) | Solid solution having high Zr content: Solid solution[2] | Particle Diameter (μm) |
|---|---|---|---|---|---|---|---|---|---|---|---|---|
| 1 | 7.0 | 1.5 | 1.5 | — | 1.0 | Rest | 25.0 | TiN—TiCN—$Al_2O_3$ | ○ | 30 | ○ | 1.5 |
| 2 | 7.0 | 3.0 | 2.0 | 3.0 | 2.0 | Rest | 20.0 | TiN—TiCN—$Al_2O_3$ | ○ | 60 | ○ | 1.2 |
| 3 | 10.0 | 3.0 | 4.0 | 1.5 | 1.5 | Rest | 15.0 | TiN—TiCN—$Al_2O_3$ | ○ | 50 | ○ | 2.4 |
| 4 | 7.0 | 2.5 | — | 1.5 | 6.0 | Rest | 60.0 | TiN—TiCN—$Al_2O_3$ | ○ | 50 | ○ | 3.8 |
| *5 | 7.0 | 0.5 | 2.0 | 0.5 | 2.0 | Rest | 40.0 | TiN—TiCN—$Al_2O_3$ | X | — | ○ | 2.0 |
| *6 | 7.0 | 5.0 | 2.0 | 2.5 | 0.5 | Rest | 5.0 | TiN—TiCN—$Al_2O_3$ | X | — | X | — |
| 7 | 10.0 | 3.0 | 2.0 | 2.0 | 3.0 | Rest | 30.0 | TiN—TiCN—$Al_2O_3$ | ○ | 140 | ○ | 2.6 |
| *8 | 10.0 | — | 4.5 | — | 0.5 | Rest | 10.0 | TiN—TiCN—$Al_2O_3$ | X | — | X | — |

Sample numbers marked with * are not within the scope of the present invention.
[1]Metals are selected from the groups 4a, 5a and 6a in the Periodic Table.
[2]Mark "○" means presence of region or solid solution, and mark "X" means absence of region or solid solution.

Each of the sintered bodies thus obtained was machined into the shape of a cutting tool. The cutting tool was then coated with a titanium-alumina composite membrane of about 5 μm, by CVD method.

Test Example

With an individual cutting tool, stainless steel was cut. Flank wear of the cutting tool (caused by direct friction of the material to be machined on the flank face of the tool) was measured. The cutting conditions were as follows.

Material to be cut: SUS304

Tool Shape: CNMG432

Cutting rate: 200 m/min.

Feed rate: 0.2 mm/rev.

Depth of cut: 2 mm

Cutting solution: Used (water soluble)

Cutting time: A 40-second cutting per pass to be repeated 15 times (10 minutes)

To evaluate the plastic deformation resistance and chipping resistance of the cutting tool, the presence or absence of deformation and damage were inspected. The results thus obtained are shown in Table 2.

TABLE 2

| Sample No. | Cutting Evaluation: Flank wear (mm) | Deformation | Damage |
|---|---|---|---|
| 1 | 0.14 | No | No |
| 2 | 0.18 | No | No |
| 3 | 0.23 | No | No |
| 4 | 0.15 | No | No |
| *5 | 0.18 | No | Yes |
| *6 | 0.21 | Yes | Yes |
| 7 | 0.25 | No | No |
| *8 | 0.33 | Yes | No |

Sample numbers marked with * are not within the scope of the present invention.

As seen from Table 2, Samples Nos. 1 to 4 and 7, each being the product of the present invention, were excellent in wear resistance, as well as plastic deformation resistance and chipping resistance. In the cutting test under the above-mentioned conditions, when the flank wear was not more than 0.25 mm, it was judged that the product had a practical wear resistance.

Sample No. 4, in which the grain diameter of the B1 type solid solution having a high Zr content was as large as 3.8 μm, exhibited excellent performance under the aforementioned conditions, however, it caused chipping when the feed rate was elevated to 0.3 mm/rev. Also, although Sample No. 7 had a region where the reduction ratio of Zr to the inside of the cemented carbide main body was small, its thickness was as large as 140 μm, and a slightly large wear occurred.

To the contrary, Comparative Sample Nos. 5, 6 and 8, each having no region where the reduction ratio of Zr to the inside of the cemented carbide main body was small, were poor in at least one of plastic deformation resistance, chipping resistance, and wear resistance. Specifically, Comparative Sample Nos. 8 was poor in wear resistance because the amount of wear exceeded 0.25 mm. Comparative Sample Nos. 6 and 8 were poor in plastic deformation resistance due to deformation. Comparative Sample Nos. 5 and 6 were poor in chipping resistance.

What is claimed is:

1. A cutting tool comprising:

a cemented carbide main body comprising a hard phase which comprises WC and at least two other compounds selected from the group consisting of carbides, nitrides and carbonitrides, wherein at least one compound contains Zr, wherein at least one compound contains a metal other than Zr of the groups 4, 5and 6a in the Periodic Table, and a binder phase comprising at least one metal of the iron group; and a coating layer formed on the surface of the cemented carbide main body, the cemented carbide main body having, in the surface portion, a region where a reduction ratio of Zr to the inside of the cemented carbide main body is smaller than a reduction ratio of the other non Zr group 4a, 5a, and 6a metals from the compounds selected from the group consisting of carbides, nitrides and carbonitrides.

2. The cutting tool according to claim 1, wherein in the cemented carbide main body, at least two B1 type solid solutions are present, one of which is a B1 type solid solution having a high Zr content.

3. The cutting tool according to claim 2, wherein a B1 type solid solution is present in a region where a reduction ratio of Zr to the inside of the cemented carbide main body is small, and the B1 type solid solution in the region is mainly the B1 type solid solution having a high Zr content.

4. The cutting tool according to claim 1, wherein Nb is included as a metal of the groups 4a, 5a and 6a in the Periodic Table.

5. The cutting tool according to claim 1, wherein the region where the reduction ratio of Zr to the inside of the cemented carbide main body is small has a thickness of 5 to 100 $\mu$m.

6. The cutting tool according to claim 2, wherein the B1 type solid solution having a high Zr content in the cemented carbide main body has a mean grain diameter of not more than 3 $\mu$m.

7. A method of cutting metal with a cutting tool according to claim 1.

8. The method according to claim 7, wherein the metal is a hardly machinable material.

9. The method according to claim 8, wherein the hardly machinable material is stainless steel.

* * * * *